United States Patent [19]

Dickovich et al.

[11] Patent Number: 4,887,534

[45] Date of Patent: Dec. 19, 1989

[54] IGNITION SYSTEM FOR HIGH INTRUSION PROJECTILE

[75] Inventors: Thomas E. Dickovich, Minneapolis; Steven P. Neubauer, Maple Grove, both of Minn.

[73] Assignee: Honeywell Inc., Minneapolis, Minn.

[21] Appl. No.: 204,814

[22] Filed: Jun. 10, 1988

[51] Int. Cl.[4] ..... F42B 5/02; F42B 5/16; F42B 13/10

[52] U.S. Cl. ..... 102/373; 102/430; 102/436; 102/439

[58] Field of Search ..... 102/373, 430, 431, 439, 102/436, 445, 469, 470, 472, 372

[56] References Cited

U.S. PATENT DOCUMENTS

| | | | |
|---|---|---|---|
| 2,620,732 | 12/1952 | Hickman | 102/373 |
| 2,657,630 | 11/1953 | Blacker | 102/372 |
| 2,872,864 | 2/1959 | Barnes et al. | 102/436 |
| 3,789,763 | 2/1974 | Donner | 102/373 |
| 4,428,294 | 1/1984 | Falkowski et al. | 102/439 |
| 4,543,885 | 10/1985 | Åkhagen et al. | 102/373 |
| 4,572,078 | 2/1986 | Bell | 102/431 |
| 4,671,179 | 6/1987 | Synofzik et al. | 102/430 |
| 4,763,577 | 8/1988 | Romer et al. | 102/431 |
| 4,770,099 | 9/1988 | Brede et al. | 102/430 |

*Primary Examiner*—David H. Brown

*Attorney, Agent, or Firm*—R. W. Jensen; E. W. Hughes

[57] ABSTRACT

An improved ignition system for a fin-stabilized, high intrusion projectile (10) comprises an elongated boom (14) and a hollow fin assembly (16) which extends rearwardly into an external cartridge case (28) containing a consumable containment bag (30) filled with granular propellant (34), and which fits slidably over a primer (54). The primer (54) comprises a stub flash tube (56) extending through the base (40) of the external cartridge case (28) and a long igniter cartridge (58) fitted within the axial bore of the stub flash tube (56). The outer walls of the igniter cartridge (58) are fabricated from a combustible material such as paper, and the interior of the igniter cartridge (58) is filled with strands of benite or a similar explosive. Both the stub flash tube (56) and the hub (17) of the fin assembly (16) are provided with a plurality of transverse drilled flash holes or openings (60) which permit the flame and hot gases from the benite or the like within the igniter cartridge (58) to spread to the granular propellant (34) in the outer cartridge.

17 Claims, 2 Drawing Sheets

IGNITION SYSTEM FOR HIGH INTRUSION PROJECTILE

BACKGROUND OF THE INVENTION

1. Field of the Invention

This invention relates in general to ammunition and explosives and, more particularly, to an ignition system for a high intrusion projectile having a granular propellant propulsion system.

2. Description of the Prior Art

The use of flash tubes in the ignition systems of fixed and semifixed gun and cannon ammunition is generally well known. One example of a round having a flash tube in its ignition system is shown in U.S. Pat. No. 2,872,864 to Barnes et al. The patent to Barnes et al. discloses a fin-stabilized round having an elongated hollow boom. The outer wall of the boom is secured by means of a frangible section to a filler plug at the bottom of the cartridge case for the round. The axial bore of the boom is slidably fitted over a metallic center-guide stud which projects forwardly through a bore in the filler plug. The center-guide stud includes an axial flash passage which communicates at its rear end with a primer located at the bottom of the cartridge case and at its front end with the bore of the boom. The bore of the boom in turn communicates with a plurality of transversely drilled holes which communicate with the interior of the cartridge case. In firing the round, the primer is detonated, causing a flame front to travel forwardly through the flash passage in the center-guide stud and outwardly through the transversely drilled holes in the boom to ignite the propellant charge in the cartridge case. The forward force of propulsion is intended to cause the frangible section at the rear of the boom to fracture, allowing the round to travel up the bore of the weapon and out of the cartridge case. At the same time, the center-guide stud offers guidance to the round and prevents the tail fins from bearing against the side walls of the cartridge case.

A serious limitation of the ignition system disclosed by Barnes et al is that the arrangement of the transversely drilled flash holes in the boom does not allow for uniform flame permeation in the bed of propellant in the cartridge case. In addition, the ignition system is expensive, difficult to assemble, and difficult to pack with the propellant charge.

One attempt to overcome the above limitations is described in U.S. Pat. No. 4,572,078 to Bell, which discloses an ignition booster to be used either in place of or in addition to a flash tube. More specifically, the ignition booster consists of a thin film of case-bonded nitrocellulose located on the inside walls and base of the cartridge case. This arrangement allows the booster propellant to be spread out over a greater surface area than is possible within a conventional flash tube. Thus, more uniform permeation of the propellant bed is possible, resulting in enhanced flame spread. However, the round shown by Bell lacks any kind of center-guide or support for increasing the radial stiffness of the round. Thus, the round and its casing are subject to lateral movement during handling and an unacceptable degree of dispersion during firing.

Therefore, a need exists for an improved propellant charge ignition system which enhances flame spread through a granular propellant while also providing projectile boom support.

SUMMARY OF THE INVENTION

In accordance with the present invention, an improved ignition system for a fin-stabilized, high intrusion projectile comprises an elongated boom and a hollow fin assembly which extends rearwardly into an external cartridge case containing a consumable containment bag filled with granular propellant, and which fits slidably over a primer. The primer comprises a stub flash tube secured to the base of the external cartridge and a long igniter cartridge fitted within the axial bore of the stub flash tube. The outer walls of the igniter cartridge are fabricated from a combustible material such as paper, and the interior of the igniter cartridge is filled with strands of benite or a similar explosive. Both the stub flash tube and the hub of the fin assembly are provided with a plurality of transverse flash holes or openings which permit the flame and hot gases from the benite or the like within the igniter cartridge to spread to the granular propellant in the propellant containment bag. A perforated, tapered fill tube, fabricated from thin consumable aluminum, is fitted over the stub flash tube and the rear end of the fin assembly, allowing the granular propellant to flow smoothly into the propellant containment bag during filling, and preventing trapping or clumping of the propellant grains in the vicinity of the fins.

When the primer is ignited, the flame and hot gases from the benite cause the consumable fill tube as well as the outer walls of the igniter cartridge and the containment bag to burn along with the granular propellant, thus producing additional propellant gases. This results in more uniform flame spread and more effective ignition than in prior art ignition systems. In addition, the configuration of the stub flash tube provides increased radial stiffness and truer alignment of the cartridge case to the projectile prior to firing.

Accordingly, it is an object of this invention to provide an improved ignition system for a high intrusion projectile which utilizes granular propellant.

Another object of the invention is to provide an ignition system with an extended primer comprising an elongated ignition cartridge fitted within a stub flash tube and extending into the interior of the boom of a projectile, the flash tube and ignition cartridge serving to provide increased radial stiffness and keep the projectile centered within the outer cartridge case.

Still another object of the invention is to provide an improved ignition system with various components fabricated from combustible materials to increase the igniting effect of the granular propellant within the round.

Yet another object of the invention is to provide an inexpensive ignition system which is easy to load and assemble.

The foregoing and other objects of the invention, as well as the invention itself, may be more fully understood from the following description when read in conjunction with the accompanying drawings.

DESCRIPTION OF THE PREFERRED EMBODIMENT

Figure 1:
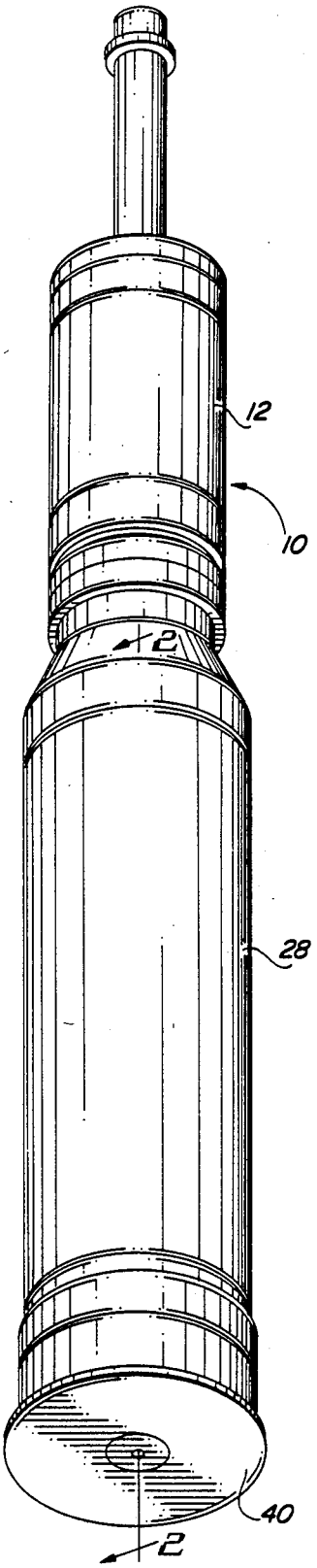
FIG. 1 is a perspective view of a high intrusion projectile having the ignition system of the present invention.
Figure 2:
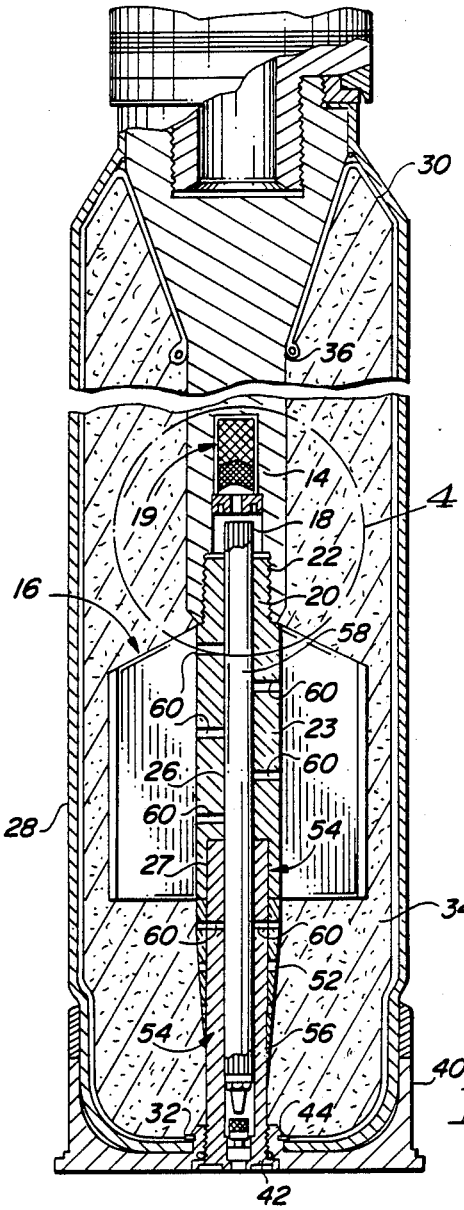
FIG. 2 is an enlarged sectional view taken through line 2—2 of FIG. 1.
Figure 3:
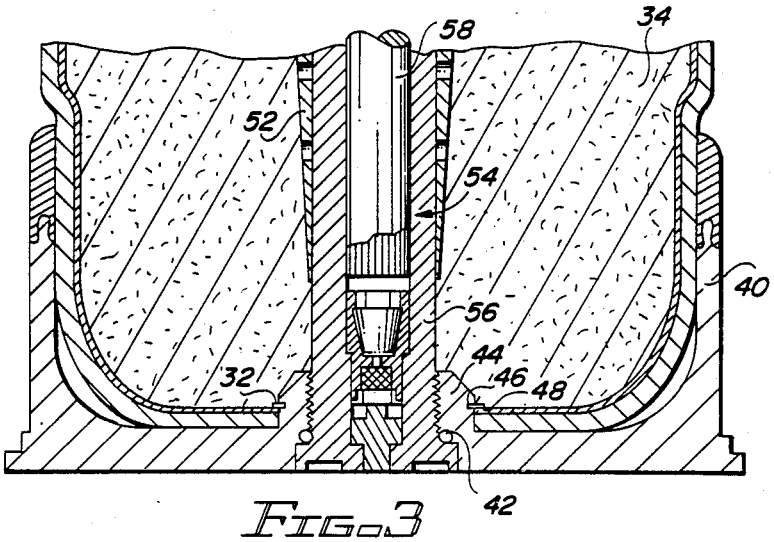
FIG. 3 is an enlarged fragmentary view of the base portion of the projectile and ignition system.
Figures 4, 5:
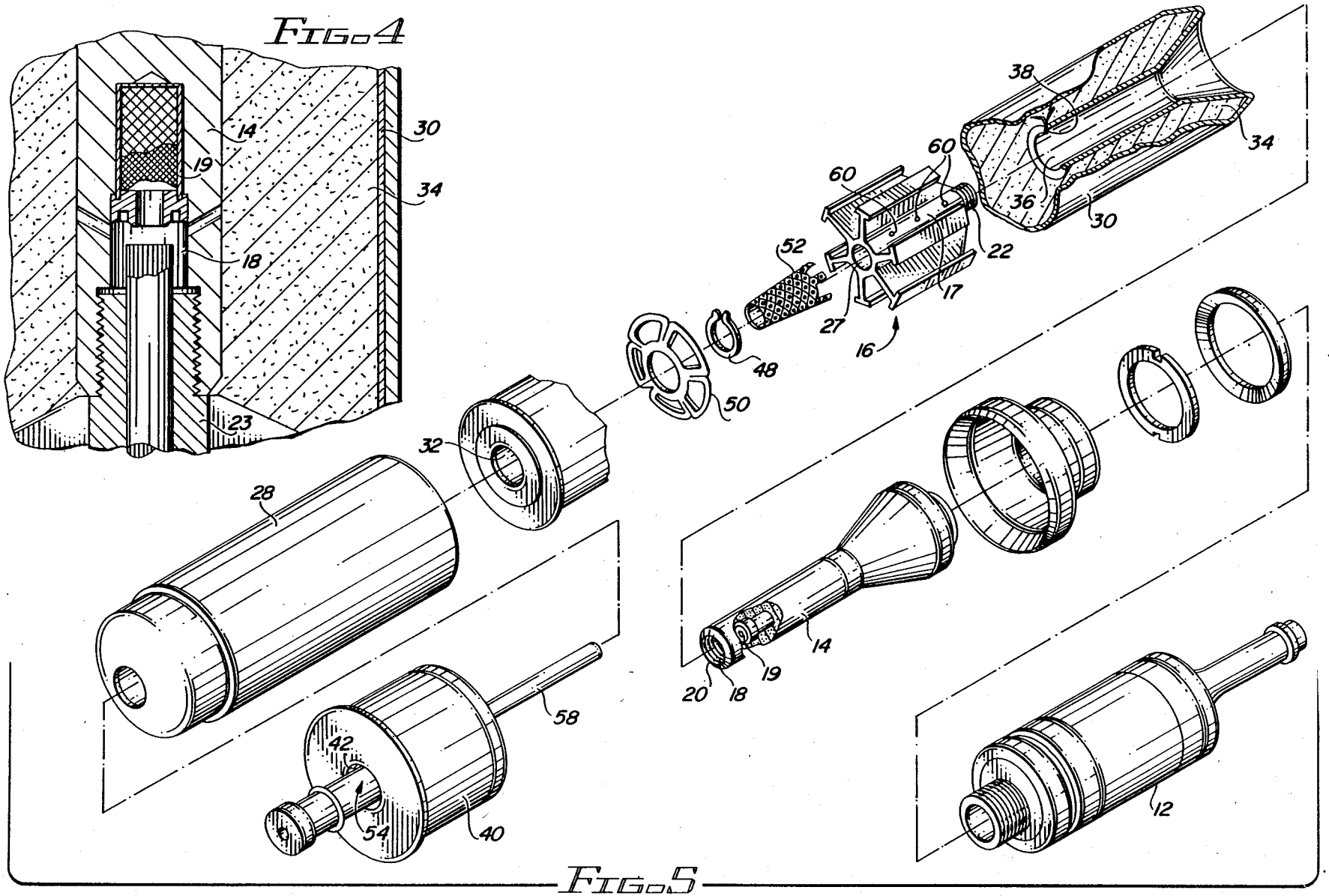
FIG. 4 is an enlarged fragmentary view of the circled region 4 of FIG. 2.
FIG. 5 is a perspective view showing the elements of the ignition system and high intrusion projectile in exploded relationship to one another.

Referring more particularly to the drawings, FIGS. 2–5 show the ignition system of the present invention in combination with a high intrusion projectile 10 including a shaped charge warhead 12 having a cylindrical outer surface for contacting the smooth bore of a weapon (not shown).

The aft portion of the projectile 10 includes an elongated boom 14. A fin assembly 16 having a central hub 17 is attached to the rear of the boom 14. The rearward end of the boom 14 defined an axial boze 18, the (zont portion of which contains a tracer assembly 19 for the round. The rear portion of the bore 18 is internally threaded as shown at 20 to receive mating threads 22 on the hub 17 of the fin assembly 16. An axial bore 26 through the hub 17 of the fin assembly 16 communicates with the axial bore 18 in the boom 14. The rear portion of the axial bore 26 is enlarged to define a counterbore 27, the purpose of which will be later explained.

The boom 14 and the fin assembly 16 of the projectile 10 extend rearwardly into a forwardly tapering external cartridge case 28 which is preferably formed of combustible pressed paper. A propellant containment bag 30 formed from viscose "Rayon" fabric prevents propellant spillage if the cartridge case 28 is ruptured by mishandling. The rear of the propellant containment bag 30 includes a fill port 32 through which loose granular propellant 34 is poured when the cartridge is loaded. The mouth 36 of the bag 30 is provided with a drawstring 38 which is used to secure the bag 30 tightly over the elongated boom 14 of the projectile.

A base assembly 40 mounted at the rear end of the external cartridge case 28 seals the external cartridge case 28 and the propellant containment bag 30, and prevents the propellant charge from spilling out. A central opening 42 in the base assembly allows access to the fill port 32 in the propellant containment bag 30. An annular boss 44 which surrounds the central opening 42 and extends inwardly into the cartridge includes a circumferential groove 46 which receives a retaining ring 48 for clamping the rear end of the propellant containment bag 30 and the external cartridge case 28 against the flat inner surface of the base assembly 40. Additionally, a resilient spring disk 50 mounted between the propellant containment bag 30 and the retainer ring 48 biases the elements of the cartridge case 28 toward the base assembly 40 and improves the tightness of this interface.

A perforated, tapered fill tube 52 fabricated from consumable aluminum is secured to the rear end of the fin assembly 16 to allow the granular propellant 34 to flow smoothly and uniformly through the fill port 32 and into the interior of the propellant containment bag 30 during loading. Additionally, the fill tube (52) allows more propellant (34) to be charged into the cartridge while keeping it from falling into the axial bore (26) through the fin assembly.

Once the granular propellant 34 has been loaded into the propellant containment bag 30, an electric primer 54 is inserted through the central opening 42 in the base assembly 40 and the fill port 32 in the propellant containment bag 30. The primer 54 comprises a stub flash tube 56, the forward end of which is slidably received in the counterbore 27 of the axial bore 26 through the hub 17 of the fin assembly 16, thus providing support for the boom 14 and increasing the radial stiffness of the assembly.

The stub flash tube 56 contains a long igniter cartridge 58 which extends through the entire length of the axial bore 26 in the hub 17 of the fin assembly 16 and continues into the bore 18 of the boom, terminating slightly rearwardly of the tracer assembly 19. The outer walls of the igniter cartridge 58 are fabricated from a combustible material such as paper, and the interior of the igniter cartridge 58 is filled with strands of benite or a similar explosive. Both the stub flash tube 56 and the hub 17 of the fin assembly 16 are provided with a plurality of transverse flash holes or openings 60 which permit the flame and hot gases from the burning benite or the like within the igniter cartridge 58 to spread to the granula propellant 34 in the propellant containment bag 30.

When the primer 54 is ignited, the flame and hot gases from the benite cause the consumable fill tube 52 as well as the outer walls of the igniter cartridge 58, the containment bag 30, and the cartridge case 28 to burn along with the granular propellant 34, thus producing additional propellant gases. The impetus provided by these propellant gases causes the projectile 10 to travel up the bore of the weapon Because the stub flash tube 56 supported the projectile 10 in a centered position within the cartridge case 28 before firing, the projectile's passage into the bore of the weapon will be unimpeded and its deviation from the desired trajectory after leaving the weapon case 28 is therefore minimal.

While the principles of the invention have now been made clear in the illustrated embodiment, there will be immediately obvious to those skilled in the art, many modifications of structure, arrangements, proportions, the elements, materials and components used in the practice of the invention and otherwise, which are particularly adapted of specific environments and operation requirements without departing from these principles. The appended claims are therefore intended to cover and embrace any such modifications within the limits only of the true spirit and scope of the invention.

We claim:

1. An ammunition round comprising:

(I) a projectile (10), said projectile (10) including
  (a) a warhead (12);
  (b) a boom (14) and fin assembly (16) formed rearwardly of said warhead (12), said boom (14) and fin assembly (16) having an axial bore (18, 26, 27) formed in the rearward end thereof; and (II) a cartridge assembly, said cartridge assembly including
  (a) an external cartridge case (28) containing a loose granular propellant (34), said boom (14) and fin assembly (16) and a portion of said warhead (12) being positioned in said external cartridge case (28) and surrounded by said granular propellant (34);
  (b) a base assembly (40) sealingly engaging the rear end of said external cartridge case (28); and
  (c) a primer (54) extending forwardly from said base assembly (40), said primer (54) including
    (i) a stub flash tube (56), said tube flash tube (56) having a forward end, said forward end being slidably received in said axial bore (27) in said boom (14) and fin assembly (16) to provide support for said boom (14) and fin assembly (16) and to increase the radial stiffness of said ammunition round, said stub flash tube (56) also comprising a plurality of transversely extending flash holes (60) communicating with the interior of said external cartridge case (28);

(ii) an elongated igniter cartridge (58) positioned within said flash tube (56) and extending through said axial bore (18, 26, 27) in said boom (14) and fin assembly (16), said igniter cartridge (58) being formed from paper and being filled with strands of benite; and (iii) a fill tube (52) secured to the rear end of boom (14) and fin assembly (16) to facilitate smooth and uniform pouring of said granular propellant (34) into the external cartridge case (28) during loading.

2. The ammunition round of claim 1, in which said fill tube (52) comprises a plurality of perforations for allowing flames and hot gases from said igniter cartridge (58) to spread to the granular propellant (34) in said external cartridge case (28).

3. The ammunition round of claim 1, in which said fill tube (52) is fabricated from a consumable material.

4. The ammunition round of claim 3, in which said fill tube (52) is made of consumable aluminum.

5. An ammunition round comprising:

(I) a high intrusion projectile (10), said projectile (10) including (a) a warhead (12);

(b) an elongated boom (14) formed rearwardly of said warhead (12), said boom (14) having an axial bore (18) formed in the rearward end thereof, said axial bore (18) containing a tracer assembly (19); and (c) a fin assembly (16), said fin assembly (16) comprising a plurality of fins projecting radially from a hub (17), said hub (17) having an axial bore (26) formed therethrough, said axial bore (26) having a front opening communicating with said axial bore (18) in said boom (14), and having an enlarged diameter rear opening defining a counterbore (27), said hub (17) further including a plurality of transversely extending flash holes (60) communicating with said a dial bore (26); and (II) a cartridge assembly, said cartridge assembly including (a) an external cartridge case (28);

b) a propellant containment bag (30) located within said external cartridge case (28), said propellant containment bag (30) being fabricated from consumable material and being filled with a loose granular propellant (34), said boom (14) and said fin assembly (16) and a portion of said warhead (12) being positioned in said propellant containment bag (30) and surrounded by said granular propellant (34);

(c) a base assembly (40) sealingly engaging the rear end of said external cartridge; and (d) a primer (54) extending forwardly from said base assembly (40), said primer (54) including (i) a stub flash tube (56), said stub flash tube (56) having a forward end, said forward end being slidably received in said counterbore (27) of said axial bore (26) through said hub (17) of said fin assembly (16) to provide support for said boom (14) and increase the radial stiffness of said ammunition round, said stub flash tube (56) also comprising a plurality of transversely extending flash holes (60) communicating with the interior of said granular propellant containment bag (30); and (ii) an elongated igniter cartridge (58) positioned within said flash tube (56) and extending through the entire length of said axial bore (26) in said hub (17) of said fi assembly (16) and continuing into the bore (18) of said boom (14), terminating slightly rearwardly of said tracer assembly (19), said igniter cartridge (58) being formed from a combustible material and being filled with explosive material.

6. The ammunition round of claim 5, in which said propellant containment bag (30) is fabricated from consumable viscose "Rayon" material.

7. The ammunition round of claim 5, in Which said igniter cartridge (58) is formed from paper.

8. The ammunition round of claim 5, in which said igniter cartridge (58) is filled with strands of benite.

9. The ammunition round of claim 5, further comprising a fill tube (52) secured to the rear end of said fin assembly (16) to facilitate smooth and uniform pouring of said granular propellant (34) into said propellant containment bag (30) during loading.

10. The ammunition round of claim 9, in which said fill tube (52) comprises a plurality of perforations for allowing flames and hot gases from said igniter cartridge (58) to spread to the granular propellant (34) in said propellant containment bag (30).

11. The ammunition round of claim 9, in which said fill tube (52) is fabricated from a consumable material.

12. The ammunition round of claim 11, in which said fill tube (52) is made of consumable aluminum.

13. An ammunition round comprising:

(I) a high intrusion projectile (10), said projectile (10) including (a) a shaped charge warhead (12);

(b) an elongated boom (14) formed rearwardly of said warhead (12), said boom (14) having an axial bore (18) formed in the rearward end thereof, said axial bore (18) containing a tracer assembly (19); and (c) a fin assembly (16), said fin assembly (16) comprising a plurality of fins projecting radially from a hub (17), said hub (17) having an axial bore (26) formed therethrough, said axial bore (26) having a front opening communicating with said axial bore (18) in said boom (14), and having an enlarged diameter rear opening defining a counterbore (27), said hub (17) further including a plurality of transversely extending flash holes (60) communicating with said axial bore (26); and (II) a cartridge assembly, said cartridge assembly including (a) a forwardly tapering external cartridge case (28);

(b) a propellant containment bag (30) secured to the inner walls of said external cartridge case (28), said propellant containment bag (30) being fabricated from a consumable material and being filled with a loose granular propellant (34), said propellant containment bag (30) having a rear end with a fill port (32) for receiving said granular propellant (34) and having a front end defining a mouth (36), said mouth (36) being tightly secured about the boom (14) of said projectile (10);

c) a base assembly (40) sealingly engaging the rear end of said external cartridge, said base assembly (40) including a central opening (42) communicating with said fill port (32) in said propellant containment bag (30); and (d) primer (54) extending through said central opening (42) in said base assembly (40) and said fill port (32) in said propellant containment bag (30), said primer (54) including (i) a stub flash tube (56), said stub flash tube (56) having a forward end, said forward end being slidably received in said counterbore (27) of said axial bore (26) through said hub (17) of said fin assembly (16) to provide support for said boom (14 and increase the radial stiffness of said ammunition round, said stub flash tube (56) also comprising a plurality of transversely extending flash holes (60) communicating with the interior of said granular propellant containment bag (30); and (ii) an elongated igniter cartridge (58) positioned within said flash tube (56) and extending through the entire length of said axial bore (26) in said hub (17) of said fin assembly (16) and continuing into the bore (18) of said boom (14), terminating slightly rearwardly of said tracer assembly (19), said igniter cartridge (58) being formed from a combustible material and being filled with explosive material.

14. The ammunition round of claim 13, further comprising a tapered fill tube (52) for facilitating smooth and uniform pouring of said granular propellant (34) into said granular propellant bag (30) during loading, said fill tube (52) having a wide end secured to said hub (17) of said fin assembly (16) and a narrow end fitted over said stub flash tube (56), said fill tube (52) being fabricated from consumable material and comprising a plurality of perforations for allowing flames and hot gases from said igniter cartridge (58) to spread to the granular propellant (34) in said propellant containment bag (30).

15. The ammunition round of claim 14, in which said propellant containment bag (30) is fabricated from consumable viscose "Rayon" material

16. The ammunition round of claim 14, in which said mouth (36) of said propellant containment bag (30) is secured about the boom (14) of said projectile (10) by means of a drawstring (38).

17. The ammunition round of claim 14, in which said igniter cartridge (58) is formed from paper and filled with strands of benite.

* * * * *